US007727378B2

(12) United States Patent
Dierickx et al.

(10) Patent No.: US 7,727,378 B2
(45) Date of Patent: Jun. 1, 2010

(54) PROCESS TO PREPARE A FISCHER-TROPSCH PRODUCT

(75) Inventors: Jan Lodewijk Maria Dierickx, Amsterdam (NL); Arend Hoek, Amsterdam (NL); Lip Piang Kueh, Amsterdam (NL)

(73) Assignee: Shell Oil Company, Houston, TX (US)

( * ) Notice: Subject to any disclaimer, the term of this patent is extended or adjusted under 35 U.S.C. 154(b) by 909 days.

(21) Appl. No.: 10/561,477

(22) PCT Filed: Jul. 2, 2004

(86) PCT No.: PCT/EP2004/051347

§ 371 (c)(1),
(2), (4) Date: Dec. 21, 2005

(87) PCT Pub. No.: WO2005/005575

PCT Pub. Date: Jan. 20, 2005

(65) Prior Publication Data

US 2007/0193923 A1 Aug. 23, 2007

(30) Foreign Application Priority Data

Jul. 4, 2003 (EP) ..... 03291660

(51) Int. Cl.
*C10G 73/02* (2006.01)

(52) U.S. Cl. ..... 208/57; 208/18; 208/19; 208/20; 208/21; 208/66; 208/78; 208/79; 208/133; 208/134; 208/142; 208/143; 208/144

(58) Field of Classification Search ..... 208/18–21, 208/27, 57, 66, 78–79, 133–134, 142–144; 585/9

See application file for complete search history.

(56) References Cited

U.S. PATENT DOCUMENTS

| | | | | |
|---|---|---|---|---|
| 4,943,672 | A | 7/1990 | Hamner et al. | 585/737 |
| 5,059,299 | A | 10/1991 | Cody et al. | 208/27 |
| 5,370,788 | A | 12/1994 | Dai et al. | 208/111 |
| 6,080,301 | A | 6/2000 | Berlowitz et al. | 208/18 |
| 6,179,994 | B1 | 1/2001 | Clark et al. | 208/27 |
| 6,375,830 | B1 | 4/2002 | Clark et al. | 208/27 |
| 2002/0173556 | A1 | 11/2002 | Moore, Jr. et al. | 518/726 |

FOREIGN PATENT DOCUMENTS

| | | | |
|---|---|---|---|
| EP | 0532118 | | 3/1993 |
| EP | 0668342 | | 8/1995 |
| EP | 0776959 | | 6/1997 |
| EP | 1204723 | | 5/2002 |
| EP | 1366134 | | 12/2003 |
| WO | 99/20720 | | 4/1999 |
| WO | 99/34917 | | 7/1999 |
| WO | 99/41332 | | 8/1999 |
| WO | WO 9941335 | * | 8/1999 |
| WO | 00/14179 | | 3/2000 |
| WO | 02/070629 | | 9/2002 |
| WO | WO 2004007647 | * | 1/2004 |
| WO | WO 2004009739 | * | 1/2004 |

OTHER PUBLICATIONS

Intl Search Report dated Dec. 2, 2004 (PCT/EP2004/051347).

* cited by examiner

*Primary Examiner*—Robert J Hill, Jr.
*Assistant Examiner*—Brian McCaig

(57) ABSTRACT

A process to prepare a waxy raffinate product by performing the following steps:

(a) subjecting a Fischer-Tropsch derived product having a weight ratio of compounds boiling above 540° C. and compounds boiling between 370 and 540° C. of greater than 2 to a hydroconversion step and (b) fractionating the effluent of step (a) to obtain products boiling in the fuels range and a waxy raffinate product boiling between 350 and 600° C.

10 Claims, No Drawings

PROCESS TO PREPARE A FISCHER-TROPSCH PRODUCT

FIELD OF THE INVENTION

The present invention related to a process to prepare base oils or the intermediate waxy raffinate product in a high yield from a Fischer-Tropsch synthesis product.

BACKGROUND OF THE INVENTION

Such processes are known from WO-A-9941332, U.S. Pat. No. 6,080,301, EP-A-0668342, U.S. Pat. No. 6,179,994 or WO-A-02070629. These processes all comprise some kind of hydroisomerisation of the Fischer-Tropsch synthesis product followed by a dewaxing step of the higher boiling fraction obtained in said hydroisomerisation.

WO-A-02070629, for example, describes a process wherein the C5 plus fraction of a Fischer-Tropsch synthesis product is first subjected to a hydrocracking/hydroisomerisation step in the presence of a catalyst consisting of platinum on an amorphous silica-alumina carrier. The effluent of this conversion step is separated into middle distillate products and a base oil precursor fraction, also referred to as a waxy raffinate product, and a higher boiling fraction. The base oil precursor fraction is catalytically dewaxed in the presence of a platinum-ZSM-S based catalyst and the heavy fraction is recycled to the hydrocracking/hydroisomerisating step.

It would be useful to improve the quality and the yield of the intermediate waxy raffinate product.

SUMMARY OF THE INVENTION

The present invention provides a process comprising:

(a) subjecting a Fischer-Tropsch derived product having a weight ratio of compounds boiling above 540° C. and compounds boiling between 370 and 540° C. of greater than 2 to a hydroconversion step and (b) fractionating the effluent of step (a) to obtain products boiling in the fuels range and a waxy raffinate product boiling between 350 and 600° C.

Applicants have found that by subjecting such a relatively heavy Fischer-Tropsch derived product to the process of the present invention a higher yield to the waxy raffinate product is obtained and the quality of the waxy raffinate is improved. It has been found that the wax content in the waxy raffinate is reduced, as expressed in its cold flow properties like pour point and cloud point, making it a better base oil precursor feedstock. Dewaxing such a waxy raffinate to base oils is more simple and more efficient.

The Fischer-Tropsch derived product comprises a Fischer-Tropsch synthesis product. With a Fischer-Tropsch synthesis product is meant the product directly obtained from a Fischer-Tropsch synthesis reaction, which product may optionally have been subjected to a distillation and/or hydrogenation step only. The Fischer-Tropsch synthesis product may be obtained by well-known processes, for example the so-called commercial Sasol process, the Shell Middle Distillate Process or by the non-commercial Exxon process. These and other processes are for example described in more detail in EP-A-776959, EP-A-668342, U.S. Pat. No. 4,943,672, U.S. Pat. No. 5,059,299, WO-A-9934917 and WO-A-9920720. Typically these Fischer-Tropsch synthesis products will comprise hydrocarbons having 1 to 100 and even more than 100 carbon atoms. This hydrocarbon product comprises normal paraffins, iso-paraffins, oxygenated products and unsaturated products. The feed to step (a) or any fractions obtained in step (a) may be hydrogenated in order to remove any oxygenates or unsaturated products.

The weight ratio of compounds boiling above 540° C. and compounds boiling between 370 and 540° C. in the feed to step (a) is greater than 2, preferably greater than 2.5, even more preferably greater than 3. The $T_{10\ wt\ \%}$ recovery point of the Fischer-Tropsch derived product is preferably below 400° C. Such a feed may be prepared by separating from the Fischer-Tropsch synthesis product part or all of the paraffin fraction boiling between 370 and 540° C. and/or adding a Fischer-Tropsch derived fraction comprising compounds boiling above 540° C. to the Fischer-Tropsch synthesis product. With boiling predominately between or above a certain value is meant that at least 80 wt % of said fraction, preferably at least 90 wt % of said fractions boils between or above the cited value.

The separated paraffin fraction boiling between 370 and 540° C. may advantageously be sold as a paraffin wax or used as feed to prepare a base oil by means of dewaxing processes as described in for example EP-A-1204723. Before the dewaxing step the fraction may suitably be subjected to a hydroisomerisation step such as described in or EP-A-776959.

The fraction boiling predominantly above 540° C. may be a paraffin wax product having a congealing point of greater than 90° C., preferably above 95° C. as isolated from a Fischer-Tropsch synthesis product.

The invention is also related to a process to simultaneously prepare two or more grades of a paraffin wax having a congealing ranging from 30 to 120° C. and a waxy raffinate product by a process comprising (i) subjecting part of the Fischer-Tropsch synthesis product to a hydrogenation step to remove oxygenates and olefins from the Fischer-Tropsch product;

(ii) isolating from the hydrogenated Fischer-Tropsch product two or more wax grades, wherein at least one grade has a congealing point between 30 and 80° C. and at least one heavy grade having a congealing point of above 90° C., preferably above 95° C. and (iii) mixing part or all of the heavy wax with another part of the Fischer-Tropsch synthesis product to obtain the Fischer-Tropsch, derived product for use in step (a).

The process of the present invention is especially advantageous when a substantial part, preferably more than 10 wt %, more preferably more than 30 wt % and even more preferably more than 50 wt % of the Fischer-Tropsch synthesis product as used in step (i) boils above 550° C. An example of a suitable process which may prepare such a heavy Fischer-Tropsch synthesis product is described in WO-A-9934917 and in AU-A-698392. When such a product is used in the above process less of the 370-540° C. fraction has to be separated from said Fischer-Tropsch synthesis product and/or less additional 540° C. plus material has to be added to obtain the same desired weight fraction. Or alternatively an even higher weight fraction is achievable thereby benefiting even more from the advantages of the present invention.

In step (a) the Fischer-Tropsch derived feed is subjected to a hydroconversion step to yield the waxy raffinate product. Step (a) is performed in the presence of hydrogen and a catalyst, which catalyst may be chosen from those known to one skilled in the art as being suitable for this reaction. Catalysts for use in step (a) typically are amorphous catalysts comprising an acidic functionality and a hydrogenation/dehydrogenation functionality. Preferred acidic functionalities are refractory metal oxide carriers. Suitable carrier materials include silica, alumina, silica-alumina, zirconia, titania and mixtures thereof. Preferred carrier materials for inclusion in the catalyst for use in the process of this invention are silica, alumina and silica-alumina. A particularly preferred catalyst comprises platinum supported on a silica-alumina carrier. If desired, but generally not preferred because of environmental reasons, the acidity of the catalyst carrier may be enhanced by applying a halogen moiety, in particular fluorine or chlorine to the carrier. Examples of suitable hydrocracking/hydroisomerisation processes and suitable catalysts are described in WO-A-200014179, EP-A-532118 and the earlier referred to EP-A-776959.

Preferred hydrogenation/dehydrogenation functionalities are Group VIII non-noble metals, for example nickel as described in WO-A-0014179, U.S. Pat. No. 5,370,788 or U.S. Pat. No. 5,378,348 and more preferably Group VIII noble metals, for example palladium and most preferably platinum. The catalyst may comprise the hydrogenation/dehydrogenation active component in an amount of from 0.005 to 5 parts by weight, preferably from 0.02 to 2 parts by weight, per 100 parts by weight of carrier material. A particularly preferred catalyst for use in the hydroconversion stage comprises platinum in an amount in the range of from 0.05 to 2 parts by weight, more preferably from 0.1 to 1 parts by weight, per 100 parts by weight of carrier material. The catalyst may also comprise a binder to enhance the strength of the catalyst. The binder may be non-acidic. Examples, include but are not limited to clays and other binders known to one skilled in the art. Preferably the catalyst is substantially amorphous, meaning that substantially no crystalline phases are present in the catalyst. Thus catalysts comprising molecular sieves, such as zeolite beta are excluded because they generally give rise to excessive heavy ends cracking instead of the desired isomerisation reaction.

In step (a) the Fischer-Tropsch derived feed is contacted with hydrogen in the presence of the catalyst at elevated temperature and pressure. The temperatures typically will be in the range of from 175 to 380° C., preferably higher than 250° C. and more preferably from 300 to 370° C. The pressure will typically be in the range of from 10 to 250 bar and preferably between 20 and 80 bar. Hydrogen may be supplied at a gas hourly space velocity of from 100 to 10000 Nl/l/hr, preferably from 500 to 5000 Nl/l/hr. The hydrocarbon feed may be provided at a weight hourly space velocity of from 0.1 to 5 kg/l/hr, preferably higher than 0.5 kg/l/hr and more preferably lower than 2 kg/l/hr. The ratio of hydrogen to hydrocarbon feed may range from 100 to 5000 Nl/kg and is preferably from 250 to 2500 Nl/kg. The conversion in step (a) as defined as the weight percentage of the feed boiling above 370° C. which reacts per pass to a fraction boiling below 370° C. is preferably at least 20 wt %, more preferably at least 25 wt %, preferably not more than 80 wt %, more preferably not more than 65 wt % and even more preferably not more than 50 wt %.

The waxy raffinate product may subsequently be dewaxed to a base oil by means of generally known solvent or catalytic dewaxing processes as described in for example EP-A-1366135 or EP-A-1366134. The waxy raffinate product may also be used in a traditional refinery environment to enhance the base oil production from a mineral oil feedstock. Because the waxy raffinate has a relatively low pour point of below 40° C., preferably below 35° C. and even more preferably below 30° C. it is easily transported by for examples ships to overseas refineries nearer the end costumer. Suitable the waxy raffinate is added to a mineral oil based feed of a catalytic dewaxing unit in order to enhance for example the viscosity index of the resultant base oil.

The invention will be illustrated by the below non-limiting Examples.

EXAMPLE 1

Feed 2 of Table 1 was subjected to a hydrocracking step wherein the feed was contacted with a 0.8 wt % platinum on amorphous silica-alumina carrier. The conditions in the hydrocracking step were: a feed Weight Hourly Space Velocity (WHSV) of 1.0 kg/l.h, no recycle, and hydrogen gas rate=1000 Nl/kg feed, total pressure=32 bar. The reactor temperature as listed in Table 2. The hydrocracker effluents were analysed and the yields and properties for the waxy raffinate product are listed in Table 2.

TABLE 1

| Sample | Fischer-Tropsch derived product 1 (feed 1) | Fischer-Tropsch derived product 2 (feed 2) |
|---|---|---|
| | (% weight fraction boiling below listed boiling point) (% weight) | |
| 370° C. | 17.9 | 18.1 |
| 540° C. | 46.3 | 38.2 |
| | Weight ratio of compounds boiling above 540° C. and compounds boiling between 370° C. and 540° C. | |
| 540° C.+/ (370° C.-540° C.) | 1.9 | 3.1 |

Comparative Experiment A

Example 1 was repeated with Feed 1 of Table 1. The results are listed in Table 2.

TABLE 2

| | Example | |
|---|---|---|
| | 1 | 2 |
| Reactor Temperature, ° C. | 333 | 336 |
| Fraction boiling below 370° C. | 57.3 | 57.2 |
| Fraction boiling between 370 and 540° C. | 20.4 | 21.8 |
| Pour point of fraction boiling between 370 and 540° C. (° C.) | +30° C. | +27° C. |
| Cloud point of fraction boiling between 370 and 540° C. (° C.) | +43° C. | +38° C. |

As can be seen by comparing the results from feed 2 in Example 1 and the comparative experiment on feed 1, is that the waxy raffinate yield on Fischer-Tropsch derived product (feed) is significantly higher (7% relative increase) for the feed 2 according to the present invention (=21.8 wt %) as compared to a situation wherein the prior art feed 1 is used (=20.4 wt %). Both pour and cloud points of the waxy raffinate fraction are significantly better for the waxy raffinate derived from feed 2 (PP=+27° C. and CP=+38° C.), as compared to the waxy raffinate derived from the prior art feed 1 (PP=+30° C. and CP=+43° C.)

The invention claimed is:

1. A process to prepare a waxy raffinate product, the process comprising:

(a) subjecting part of a Fischer-Tropsch synthesis product to a hydrogenation step to remove oxygenates and olefins from the Fischer-Tropsch product;

(b) isolating for the hydrogenated Fischer-Tropsch product two or more wax grades, wherein at least one wax grade has a congealing point between 30 and 80° C. and at least one heavy grade has a congealing point of above 90° C.;

(c) mixing part or all of the heavy wax with another part of the Fischer-Tropsch synthesis product to obtain a Fischer-Tropsch product having a weight ratio of compounds boiling above 540° C. and compounds boiling between 370 and 540° C. of greater than 2 to be used in step (d), wherein two or more grades of a paraffin wax having a congealing point ranging from 30° C. to 120° C. and a waxy raffinate product are prepared simultaneously;

(d) subjecting the Fischer-Tropsch derived product having a weight ratio of compounds boiling above 540° C. and compounds boiling between 370 and 540° C. of greater than 2 to a hydroconversion step; and (e) fractionating the effluent of step (d) to obtain products boiling in the fuels range and a waxy raffinate product boiling between 350 and 600° C.

2. The process of claim 1, wherein the weight ratio of compounds boiling above 540° C. and compounds boiling between 370 and 540° C. is greater than 2.5.

3. The process of claim 2, wherein the T10 wt % recovery point of the Fischer-Tropsch derived product is below 400° C.

4. The process of claim 2, wherein the Fischer-Tropsch derived product in step (a) is prepared by separating from a Fischer-Tropsch synthesis product part or all of the paraffin fraction boiling between 370 and 540° C.

5. The process of claim 2, wherein the Fischer-Tropsch derived product in step (a) is prepared by adding a Fischer-Tropsch derived fraction comprising compounds boiling above 540° C. to a Fischer-Tropsch synthesis product.

6. The process of claim 2, further comprising subjecting the waxy raffinate to a dewaxing step.

7. The process of claim 1, wherein the T10 wt % recovery point of the Fischer-Tropsch derived product is below 400° C.

8. The process of claim 1, wherein the Fischer-Tropsch derived product in step (a) is prepared by separating from a Fischer-Tropsch synthesis product part or all of the paraffin fraction boiling between 370 and 540° C.

9. The process of claim 1, wherein the Fischer-Tropsch derived product in step (a) is prepared by adding a Fischer-Tropsch derived fraction comprising compounds boiling above 540° C. to a Fischer-Tropsch synthesis product.

10. The process of claim 1, further comprising subjecting the waxy raffinate to a dewaxing step.

* * * * *